US009837750B2

(12) United States Patent
Wu et al.

(10) Patent No.: US 9,837,750 B2
(45) Date of Patent: Dec. 5, 2017

(54) ELECTRICAL CONNECTOR ASSEMBLY HAVING CONTACT PROTECTOR

(71) Applicant: FOXCONN INTERCONNECT TECHNOLOGY LIMITED, Grand Cayman (KY)

(72) Inventors: Jerry Wu, Irvine, CA (US); Jian-Jun Zhu, Kunshan (CN); Qing-Man Zhu, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/710,920

(22) Filed: May 13, 2015

(65) Prior Publication Data

US 2015/0333432 A1 Nov. 19, 2015

(30) Foreign Application Priority Data

May 13, 2014 (CN) ..... 2014 1 0199754

(51) Int. Cl.

| | |
|---|---|
| ***H01R 13/46*** | (2006.01) |
| ***H01R 13/62*** | (2006.01) |
| ***H01R 13/24*** | (2006.01) |
| ***H01R 13/502*** | (2006.01) |

(52) U.S. Cl.

CPC ..... *H01R 13/46* (2013.01); *H01R 13/24* (2013.01); *H01R 13/502* (2013.01); *H01R 13/6205* (2013.01)

(58) Field of Classification Search

CPC ..... H01R 13/453; H01R 13/4538

USPC ..... 439/39, 140, 141, 136, 137

See application file for complete search history.

(56) References Cited

U.S. PATENT DOCUMENTS

| | | | | |
|---|---|---|---|---|
| 6,340,320 | B1 | 1/2002 | Ogawa | |
| 7,223,108 | B2 * | 5/2007 | Chiang | H01R 13/4538 439/137 |
| 7,311,526 | B2 | 12/2007 | Rohrbach et al. | |
| 7,329,151 | B2 | 2/2008 | Wu | |
| 7,341,458 | B1 | 3/2008 | Koh | |
| 7,632,134 | B2 | 12/2009 | Su et al. | |
| 7,661,990 | B1 * | 2/2010 | Chiang | H01R 13/6582 439/607.35 |
| 8,535,088 | B2 | 9/2013 | Gao et al. | |
| 9,065,205 | B2 * | 6/2015 | Gao | H01R 13/508 |
| 2013/0065407 | A1 * | 3/2013 | Schichl | H01R 13/5841 439/39 |

(Continued)

FOREIGN PATENT DOCUMENTS

| | | | |
|---|---|---|---|
| CN | 102918718 | A | 2/2013 |
| CN | 103124025 | A | 5/2013 |
| CN | 203787661 | U | 8/2014 |

*Primary Examiner* — Tulsidas C Patel
*Assistant Examiner* — Marcus Harcum
(74) *Attorney, Agent, or Firm* — Wei Te Chung; Ming Chieh Chang

(57) ABSTRACT

An electrical connector including: a magnetic element having a cavity; a contact protector movably accommodated in the cavity, the protector defining a front end and a plurality of slots through the front end; a plurality of contacts accommodated in the slots, each contact being retractable and having a front end located in the front end of the contact protector; and an elastic element urging the contact protector to extend the front end thereof out of the cavity.

12 Claims, 12 Drawing Sheets

(56) References Cited

U.S. PATENT DOCUMENTS

| | | | | |
|---|---|---|---|---|
| 2013/0210244 | A1 | 8/2013 | DiFonzo et al. | |
| 2015/0311619 | A1* | 10/2015 | Kato | H01R 13/6594 439/137 |

* cited by examiner

ELECTRICAL CONNECTOR ASSEMBLY HAVING CONTACT PROTECTOR

BACKGROUND OF THE INVENTION

1. Field of the Invention

The present invention relates generally to an electrical connector assembly, and more particularly to an electrical connector assembly having contact protector.

2. Description of Related Arts

U.S. Pat. No. 7,311,526. issued on Dec. 25, 2007, discloses an electrical plug and receptacle relying on magnetic force to maintain coupling. Each of the plug and the receptacle comprises a magnetic element and a plurality of contacts accommodated in the magnetic member.

U.S. Pat. No. 7,632,134, issued on Dec. 15, 2009, discloses an electrical connector including a magnetic element having a cavity, a contact protector immovably accommodated in the cavity, the protector defining a front end and a plurality of slots through the front end, and a plurality of contacts accommodated in the slots. Each contact is retractable, i.e., POGO-type contact, and has a front end located in the front end of the contact protector. The magnetic connector further includes an internal printed circuit board and a terminal block receiving the contacts.

SUMMARY OF THE INVENTION

Accordingly, an object of the present invention is to provide an electrical connector assembly having a contact protector.

To achieve the above object, an electrical connector assembly comprises: a first connector comprising: a first magnetic element having a cavity, a contact protector movably accommodated in the cavity, the protector defining a front end and a plurality of slots through the front end, a plurality of first contacts accommodated in the slots, each first contact being retractable and having a front end located in the front end of the contact protector, and an elastic element urging the contact protector to extend the front end thereof out of the cavity; and a second connector for mating with the first connector, the second connector comprising a second magnetic element and a plurality of second contacts accommodated in the second magnetic element; wherein the first contacts together with the contact protector are movable rearwardly to resiliently resist against the second contacts when the first connector mates with the second connector.

Other objects, advantages and novel features of the invention will become more apparent from the following detailed description when taken in conjunction with the accompanying drawings.

DETAILED DESCRIPTION OF THE PREFERRED EMBODIMENT

Figure 1:
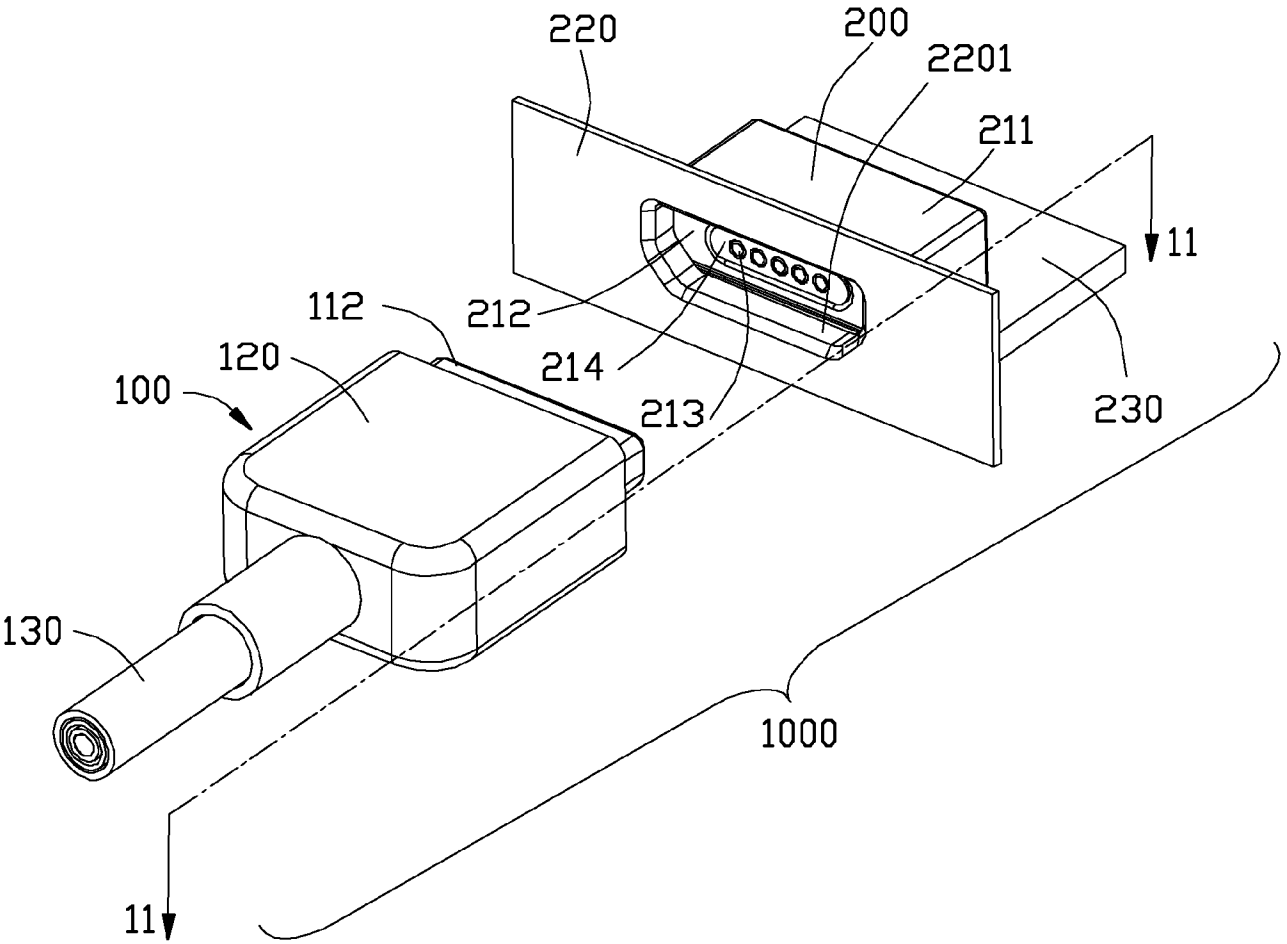
FIG. 1 is a perspective, assembled view of an electrical connector assembly when a first connector is not mated with a second connector of the present invention.
Figure 2:
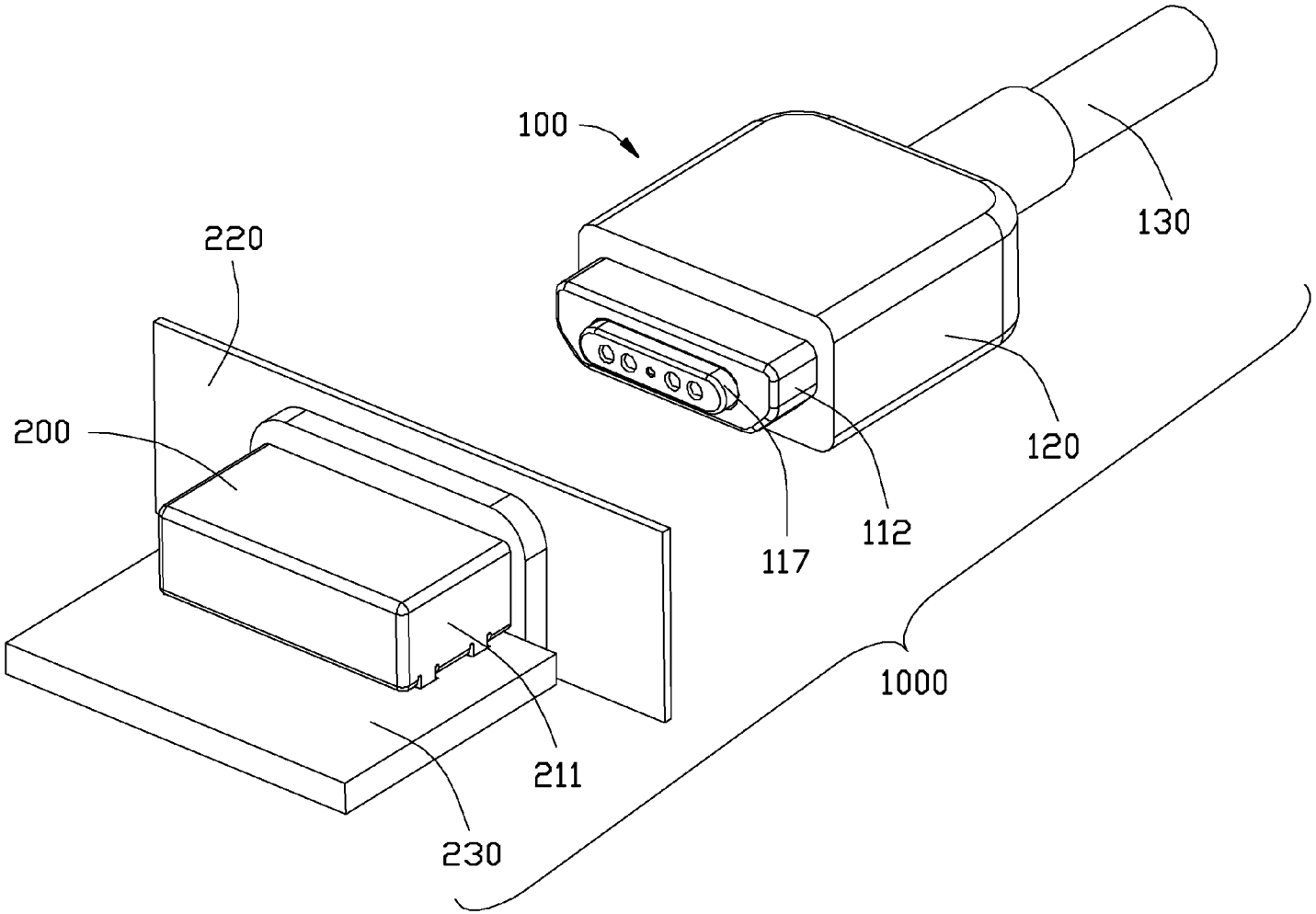
FIG. 2 is a perspective, assembled view of the electrical connector assembly, taken from a different view shown in FIG. 1.
Figure 3:
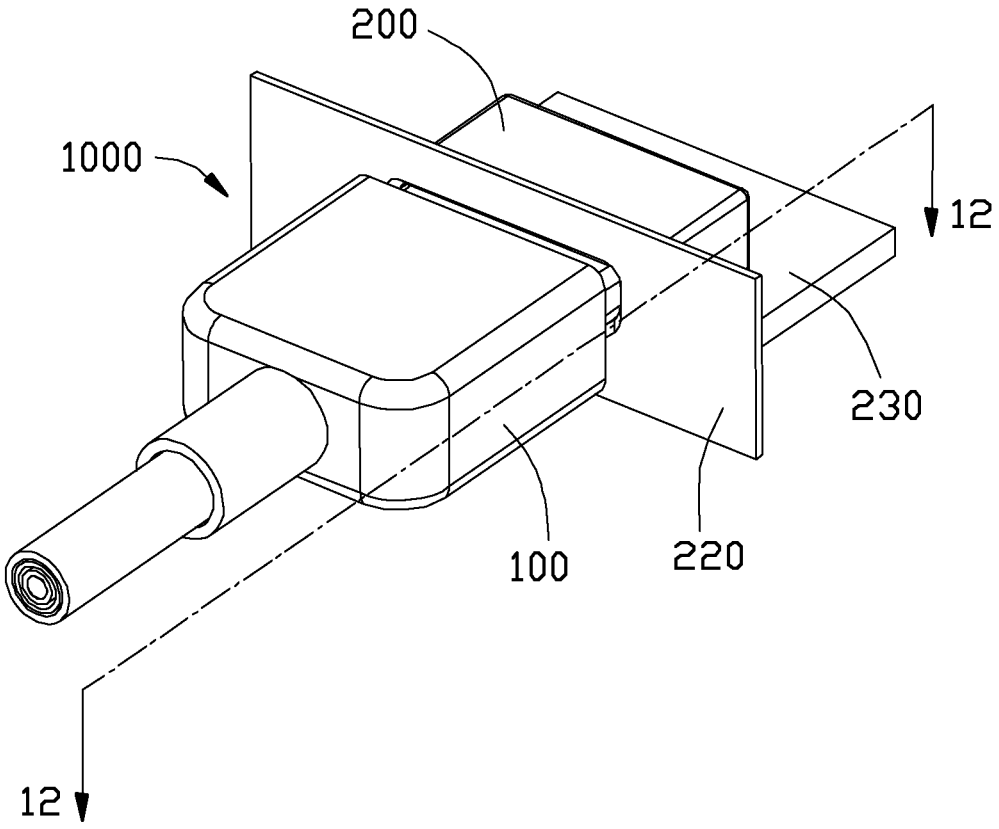
FIG. 3 is a perspective, assembled view of an electrical connector assembly when a first connector is mated with a second connector of the present invention.
Figure 4:
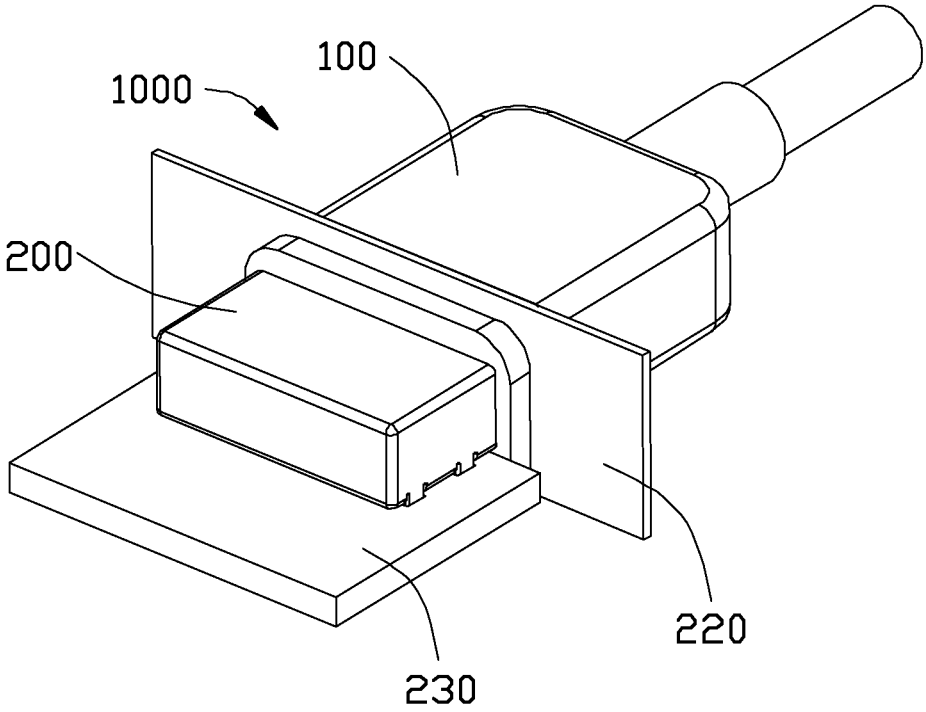
FIG. 4 is a perspective, assembled view of the electrical connector assembly, taken from a different view shown in FIG. 3.
Figure 5:
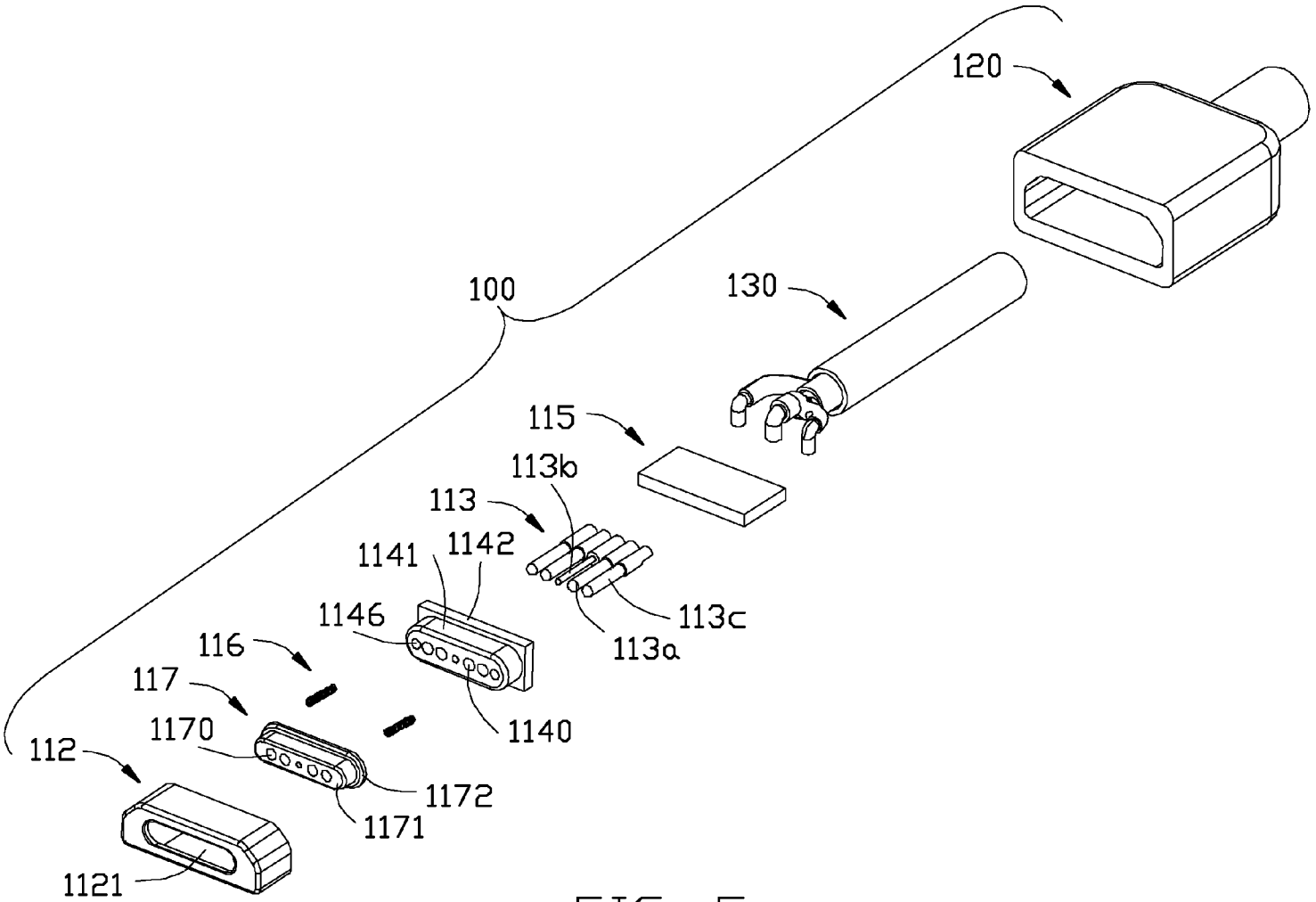
FIG. 5 is a perspective, exploded view of the first connector of the electrical connector assembly shown in FIG. 1.
Figure 6:
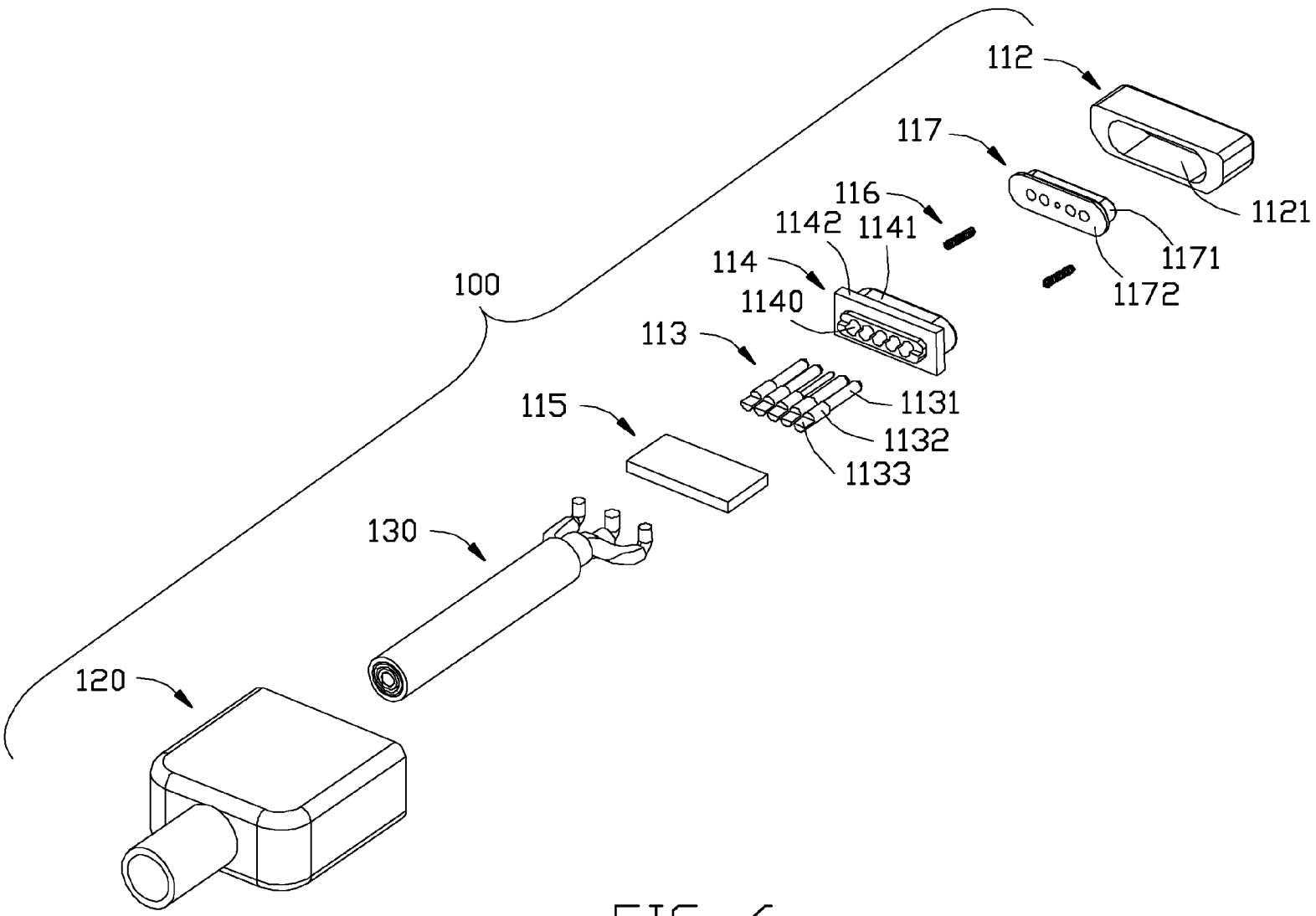
FIG. 6 is a perspective, exploded view of the first connector taken from a different view shown in FIG. 5.
Figure 7:
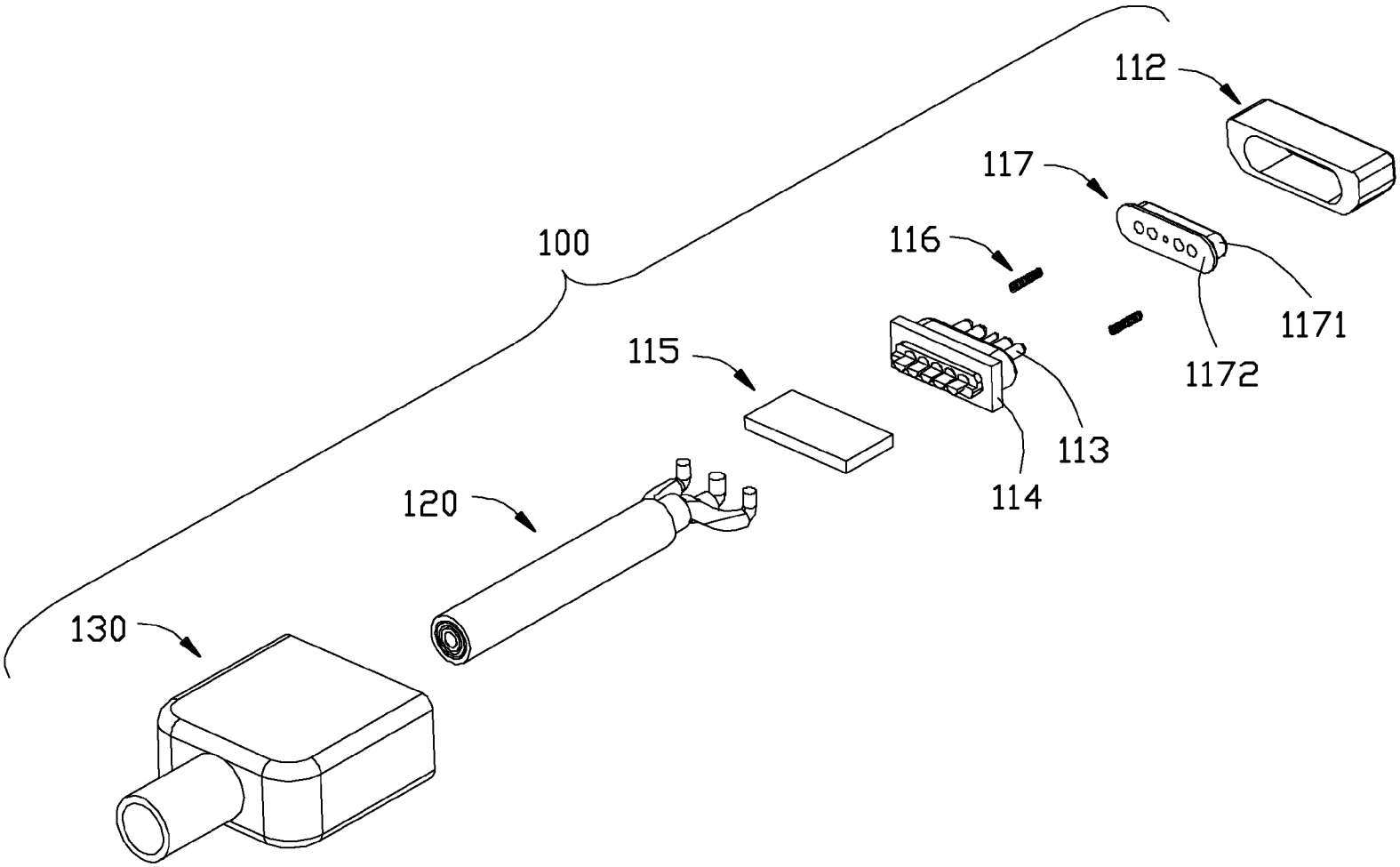
FIG. 7 is a perspective, partially assembled view of the first connector shown in FIG. 6.
Figure 8:
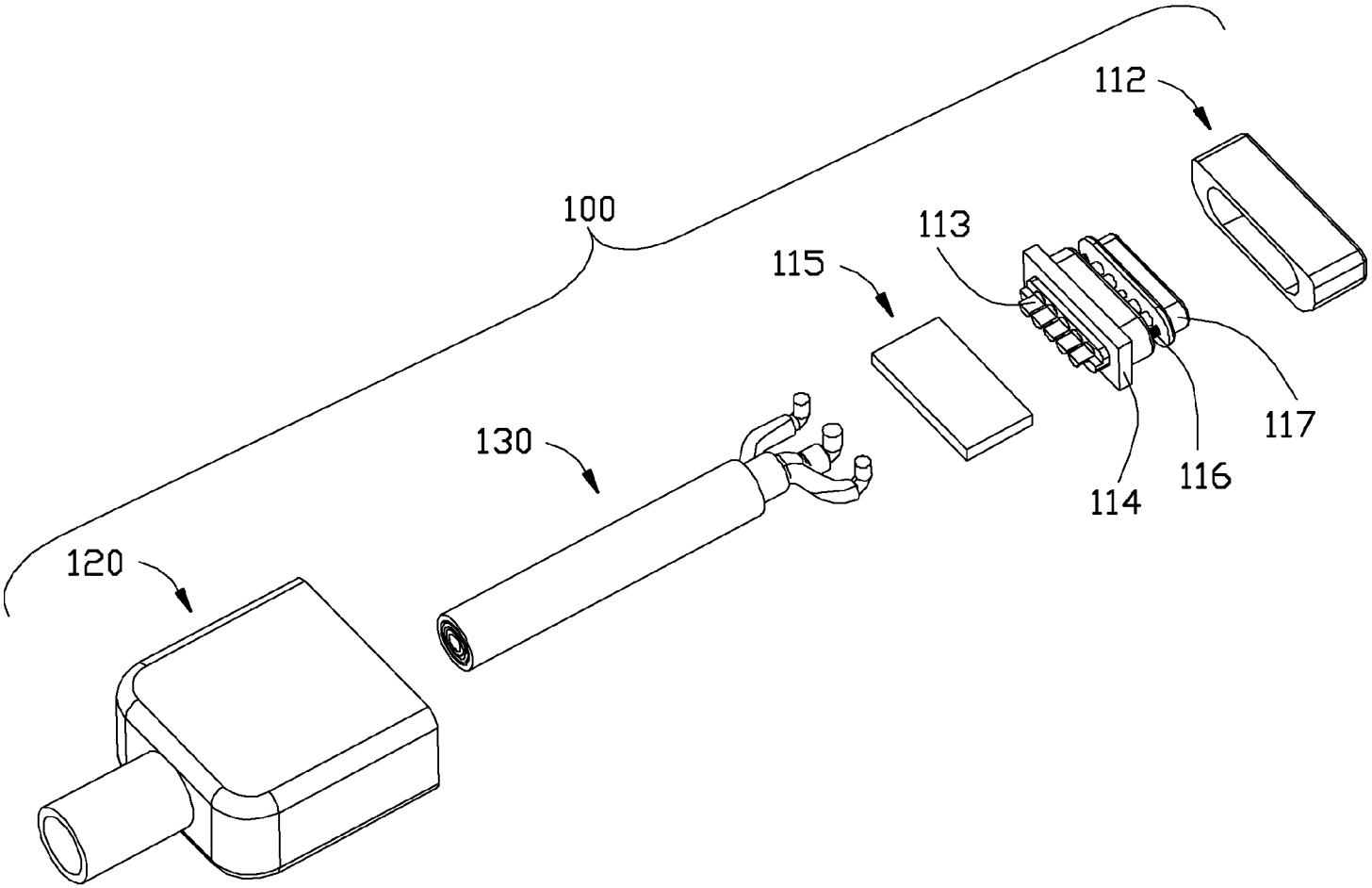
FIG. 8 is a perspective, further assembled view of the first connector shown in FIG. 7.
Figure 9:
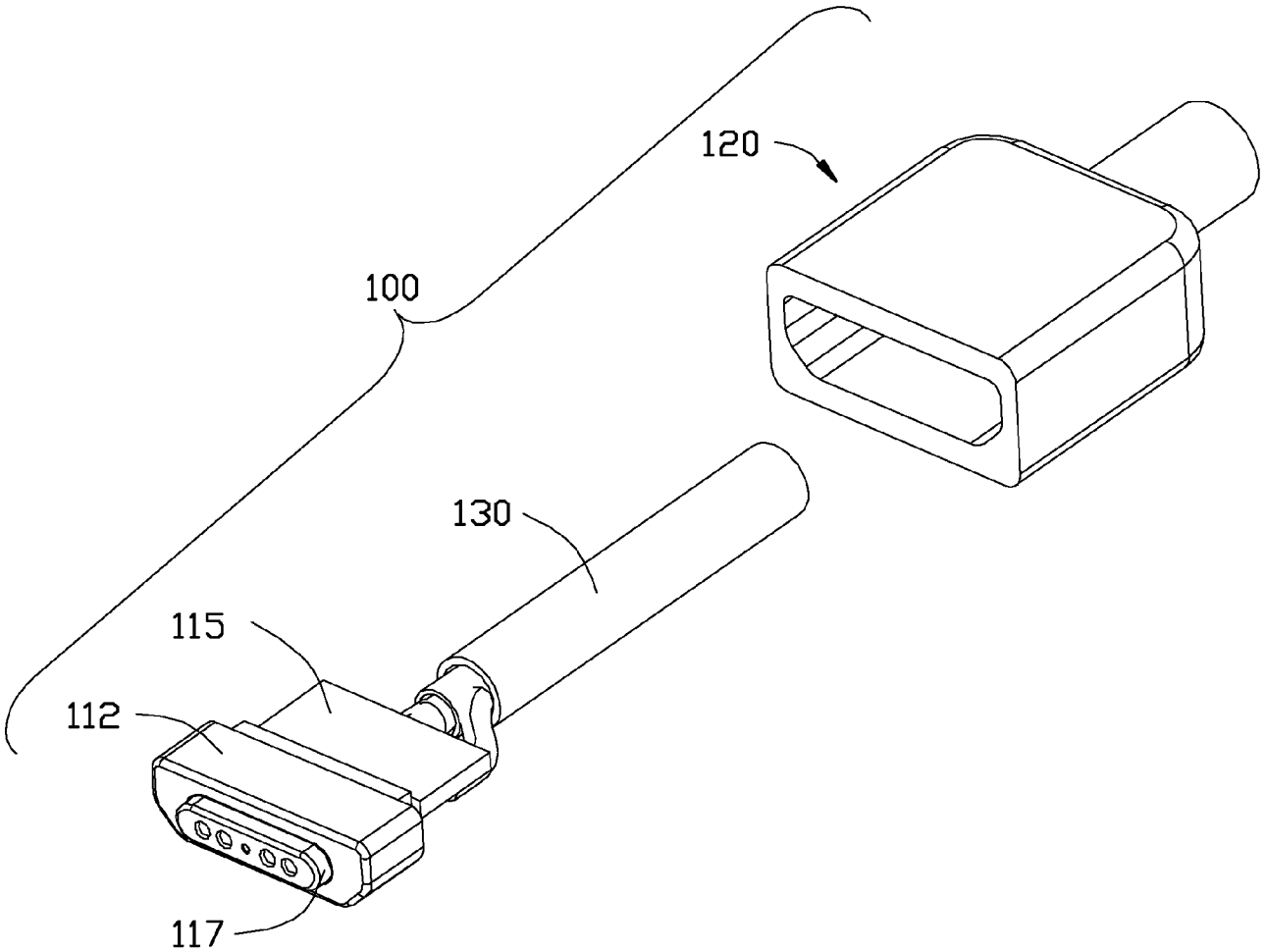
FIG. 9 is a perspective, further assembled view of the first connector shown in FIG. 8.
Figure 10:
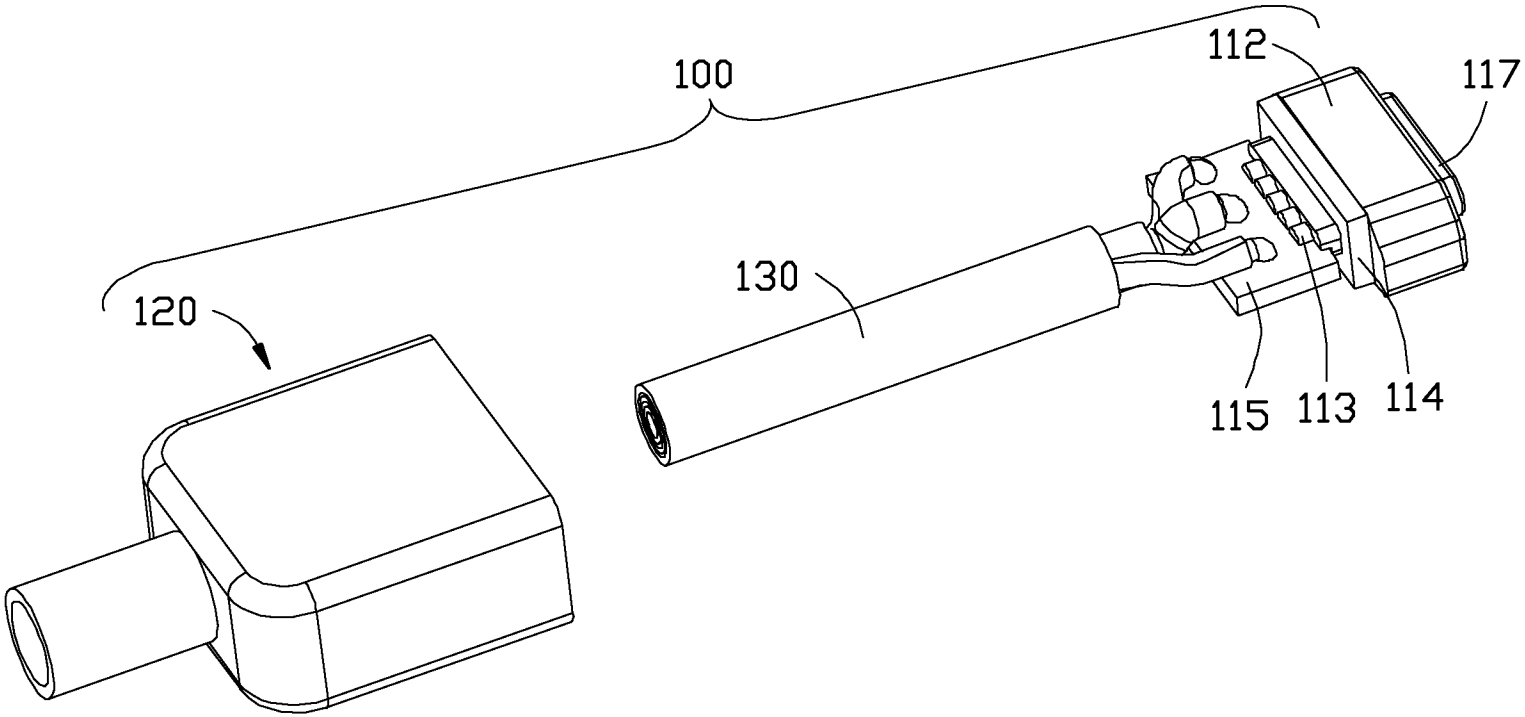
FIG. 10 is a perspective, further assembled view of the first connector shown in FIG. 9.

Reference will now be made in detail to the preferred embodiment of the present invention.

Referring to FIGS. 1 to 10, an electrical connector assembly 1000 of the present invention comprises a first connector 100, a second connector 200, a printed circuit board 230 and a panel 220 located at a front end of the second connector 200 for protecting the second connector 200.

Referring to FIGS. 5 to 10, the first connector 100 comprises a plurality of first contacts 113 arranged along the transverse direction, a first spacer/housing 114 accommodating the first contacts 113, a contact protector 117 receiving a front end of the first contact 113, an elastic element 116 located between the first spacer 114 the contact protector 117, a first magnetic element 112 assembled to the first spacer 114, a printed circuit board 115 assembled to a rear of the first spacer 114 and connecting the first contact 113 electrically, a cable 130 connecting with the printed circuit board 115 and a cover 120 assembled to a rear end of the first magnetic element 112 and a front end of the cable 130. The first magnetic element 112 defines a cavity 1121. The first contacts 113, the first spacer 114, the elastic element 116 and the contact protector 117 are accommodated in the cavity 1121. The first contact 113 and the contact protector 117 have a front surface located outside of the cavity 1121 respectively. The first contact 113 has a part located outside of the cavity 1121 and accommodated in the contact protector 117. In the embodiment, the elastic element 116 is spring. The first spacer 114 defines a plurality of holes 1146. One end of the springs are accommodated into the holes 1146, and another end of the springs resist against a rear surface of the contact protector 117. The contact protector 117 will move back, the elastic element 116 will be compressed and the front surface of the first contact 113 will be out of the front surface of the contact protector 117 if acted on by an external force.

The first contacts 113 are retractable, and comprise a first signal contact **113*b*, a pair of first power contacts 113*a* located on two sides of the first signal contact 113*b* and a pair of first grounding contacts 113*c* located on two sides of the first power contacts 113*a*. Each first contact 113 comprises a mating portion 1131 mating with the second connector 200 electrically, a holding portion 1132 extending rearwardly from the mating portion 1131 and fixing the first contact 113, and a connecting portion 1133 extending rearwardly from the holding portion 1132 and connected with the printed circuit board 115. The holding portion 1132 is thicker than the mating portion 1131 and the connecting portion 1133**.

The first spacer 114 is made of plastic material, and comprises a main portion 1141 and a rear portion 1142 extending rearwardly from the main portion 1141. The rear portion 1142 is wider than the main portion 1141. The first spacer 114 defines a plurality of grooves 1140 extending through the main portion 1141 and the rear portion 1142 and receiving the first contacts 113. The mating portions 1131 of the first contacts 113 reach out of the grooves 1140. The main portion 1141 of the first spacer 114 defines a plurality of holes 1146 receiving the elastic element 116, and one end of the elastic element 116 is accommodated in the holes 1146.

The contact protector 117 is made of plastic material, and comprises a mounting portion 1172 connecting the elastic element 116, a protecting portion 1171 extending forwardly from the mounting portion 1172 and a plurality of slots 1170 extending through the protecting portion 1171 and the mounting portion 1172 and receiving the front end of the first contacts 113. The protecting portion 1171 is thinner than the mounting portion 1172. The mating portions 1131 of the first contacts 113 can expand and contract in the slots 1170.

The first magnetic element 112 surrounds the main portion 1141 and defines a receiving chamber 1121 extending through a front surface and a rear surface thereof. The panel 220 defines an asymmetric port 2201 along an up-to-down direction thereof. The periphery of the magnetic element 112 is corresponding to the port 2201 of the panel 220, so that the magnetic element 112 can enter into the port 2201 of the panel 220 along a single direction.

In assembly, the first contact 113 is assembled to the first spacer 114. The contact protector 117 is assembled to the front end of the first contact 113. One end of the elastic element 116 is accommodated into the hole 1146 of the first spacer 114, the other one end of the elastic element 116 resist against the mounting portion 1172 of the rear surface of the contact protector 117. The first magnetic element 112 is assembled to the main portion 1141 of the first spacer 114 and the contact protector 117. The first contact 113 and the cable 130 are assembled to the printed circuit board 115 electrically. The cover 120 is assembled to the rear end of the first magnetic element 112 and the front end of the cable 130.

Referring to FIGS. 1 to 4, and FIGS. 11 to 12, the second connector 200 comprises a plurality of second contacts 213, a second spacer 214 receiving the second contacts 213, a second magnetic element 212 assembled to the second spacer 214, a metal shell 211 assembled to the second magnetic element 212. The second magnetic element 212 can attract the first magnetic element 112 along a direction. The second contacts 213 are accommodated to the second magnetic element 212. A front surface of the second contact 213 do not exceed a front surface of the second magnetic element 212. In assembly, the second contact 213 is assembled to the second spacer 214. The second magnetic element 212 is assembled to the second spacer 214. At last, the metal shell 211 is assembled to the second magnetic element 212 and the second spacer 214.

Figure 11:
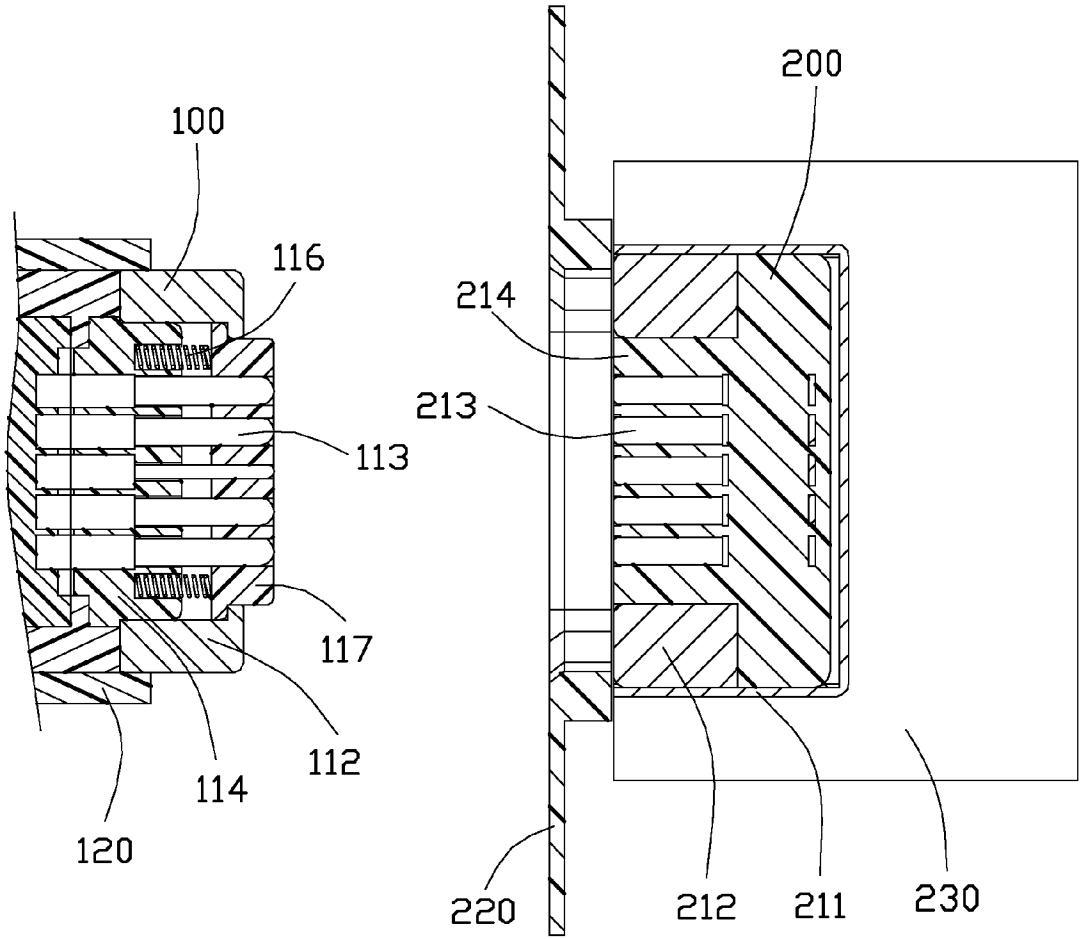
FIG. 11 is a cross-section view taken along line 11-11 of FIG. 1.

Referring to the FIG. 11, when the first connector 100 does not mate with the second connector 200, the elastic element 116 is under a free state, and the front end of the first contact 113 is accommodated in the contact protector 117 for avoiding the first contacts 113 being damaged by an external force.

Figure 12:
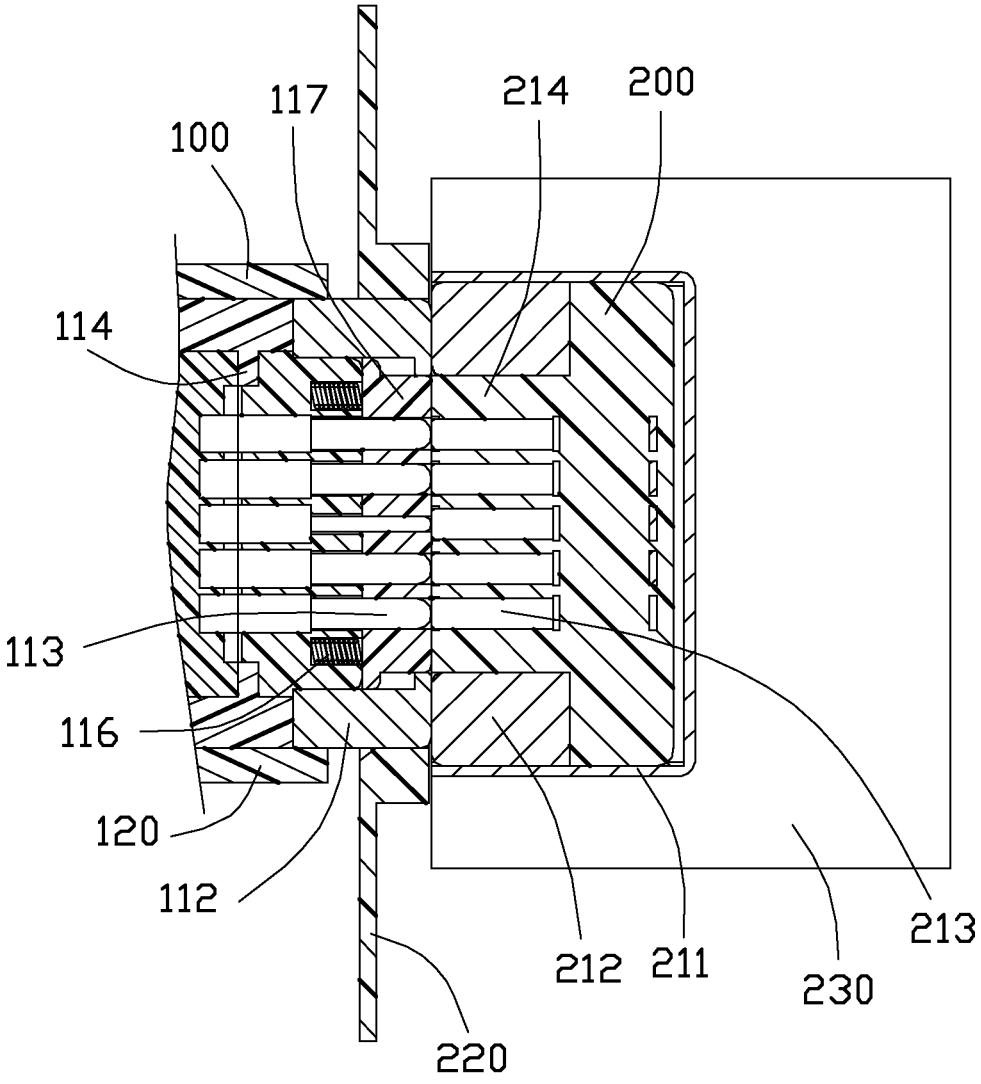
FIG. 12 is a cross-section view taken along line 12-13 of FIG. 3.

Referring to FIG. 12, when the first connector 100 mates with the second connector 200, the first magnetic element 112 attracts the second magnetic element 212 driving the first contacts 113 and the contact protector 117 to move forwardly. But the first contacts 113 and the contact protector 117 moving forwardly are stopped by the second spacer 214, the front end of the contact protector 117 and the first contacts 113 move rearwardly, hence the contact protector 117 move rearwardly to compress the elastic element 116, and the first contacts 113 are compressed. At last, under all force, the first magnetic element 112 attracts with the second magnetic element 212, the contact protector 117 resists against the second spacer 214, the first contacts 113 resist against the second contacts 213. Resilience forces of the first contacts 113 and the elastic element 116 are weaker than a resilience force of the first and second magnetic elements, the resilience force of elastic element 116 is weaker than the resilience force of the first contacts 113, so that the first contacts 113 and the second contacts 213 connect with each other electrically and steadily by the stronger resilience fore of the first contacts 113.

In the present invention, when the first connector 100 does not mate with the second connector 200, the front end of the first contact 113 are accommodated in the contact protector 117 for protecting the first contacts 113. When the first connector 100 mates with the second connector 200, the first contacts 113 and the second contacts 213 connect with each other electrically and steadily as a result of the resilience force of the contacts 113 is stronger than the resilience force of the elastic element 116.

What is claimed is:

1. An electrical connector assembly comprising:

a first connector comprising:

a first magnetic element having a cavity;

a contact protector movably accommodated in the cavity, the protector defining a front end and a plurality of slots through the front end;

a plurality of first contacts accommodated in the slots, each first contact being retractable and having a front end located in the front end of the contact protector; and an elastic element urging the contact protector to extend the front end thereof out of the cavity; and a second connector for mating with the first connector, the second connector comprising a second magnetic element and a plurality of second contacts accommodated in the second magnetic element; wherein the first contacts together with the contact protector are movable rearwardly to resiliently resist against the second contacts when the first connector mates with the second connector; wherein the elastic element is accommodated in the cavity, and the contact protector moves when the elastic element deforms; wherein the elastic element is discrete from and located beside the first contacts, and the contact protector is urged by only the elastic element.

2. The electrical connector assembly as claimed in claim 1, wherein when the first connector mates with the second connector, the elastic element is compressed and the first contacts resist against the second contacts.

3. The electrical connector assembly as claimed in claim 2, wherein the first connector comprises a first spacer accommodating the first contacts.

4. The electrical connector assembly as claimed in claim 3, wherein the first spacer defines a hole, and one end of the elastic element is accommodated in the hole and another end of the elastic element resists against a rear surface of the contact protector.

5. The electrical connector assembly as claimed in claim 3, wherein the first spacer comprises a main portion and a rear portion extending rearwardly from the main portion, and the rear portion is wider than the main portion.

6. The electrical connector assembly as claimed in claim 5, wherein the first spacer defines a plurality of grooves extending through the main portion and the rear portion and receiving corresponding first contacts.

7. An electrical connector comprising:

a magnetic element having a cavity;

a contact protector movably accommodated in the cavity, the protector defining a front end and a plurality of slots through the front end;

a plurality of contacts accommodated in the slots, each contact being retractable and having a front end located in the front end of the contact protector; and an elastic element urging the contact protector to extend the front end thereof out of the cavity, further comprising a spacer receiving the contacts and the elastic element is located between the spacer and the contact protector; wherein the elastic element is discrete from and located beside the contacts, and the contact protector is urged by only the elastic element.

8. The electrical connector as claimed in claim 7, wherein the front ends of the contacts are located out of the slots when the elastic element is compressed.

9. The electrical connector as claimed in claim 8, wherein the spacer defines a hole receiving one end of the elastic element, and another end of the elastic element resists against a rear surface of the contact protector.

10. An electrical connector assembly comprising:

a first electrical connector including a first insulative housing;

a plurality of first contacts disposed in the first housing, each of said first contacts including a contacting section moveable along a front-to-back direction between opposite front and rear positions;

a contact protector disposed in front of the first housing and moveable along the front-to-back direction between opposite front and rear locations; and a first mating face at which both the rear position and the rear location are defined; wherein said first mating face is immoveable in said front-to-back direction for mating with a complementary connector, wherein said first mating face is defined by a first magnetic element, which is located in front of the first housing and beyond which the front position and the front location reside forwardly in the front-to-back directions; wherein the contact protector is urged to move along the front-to-back direction by only an elastic element which is discrete from and located beside the first contacts.

11. The electrical connector assembly as claimed in claim 10, further including a second electrical connector with a plurality of second contacts each having a stationary contacting portion in the front-to-back direction; wherein said stationary contacting portion is essentially flush with a second mating face formed on a second magnetic element of the second electrical connector, and said second mating face abuts against the first mating face in the front-to-back direction during mating.

12. The electrical connector assembly as claimed in claim 11, wherein the first magnetic element surrounds the plurality of first contacts and received in the second electrical connector during mating.

* * * * *